US005368301A

United States Patent [19]

Mitchell

[11] Patent Number: 5,368,301

[45] Date of Patent: Nov. 29, 1994

[54] DOUBLE SIZED PUZZLE

[76] Inventor: Dennis E. Mitchell, 200 Packer Rd., Mystic, Conn. 06355

[21] Appl. No.: 186,532

[22] Filed: Jan. 26, 1994

Related U.S. Application Data

[63] Continuation-in-part of Ser. No. 7,366, Apr. 20, 1993.

[51] Int. Cl.[5] ..... A63F 9/10

[52] U.S. Cl. ..... 273/157 R

[58] Field of Search ..... 273/157 R, 157 A, 156; D21/104, 105

[56] References Cited

U.S. PATENT DOCUMENTS

| | | | |
|---|---|---|---|
| D. 29,195 | 8/1898 | Mitchell | D21/104 |
| D. 170,113 | 8/1953 | Sibrik et al. | D21/105 |
| D. 267,895 | 2/1983 | Petrie | D21/1 |
| D. 301,158 | 5/1989 | Fitzpatrick | D21/104 |
| D. 320,050 | 9/1991 | Mannino | D21/105 |
| D. 332,288 | 1/1993 | Murphy, Sr. | D21/104 X |
| 1,261,710 | 4/1918 | Coyle | 273/157 R |
| 1,339,399 | 5/1920 | Kemp | 273/157 R |
| 1,532,875 | 4/1925 | Brown | 273/156 X |
| 1,558,165 | 10/1925 | Haswell | 273/156 |
| 1,676,641 | 7/1928 | Eschenbach | 273/157 R |
| 1,948,962 | 2/1934 | Decker | 273/157 R |
| 2,953,380 | 9/1960 | Hassenbach | 273/157 R |
| 2,984,489 | 5/1961 | Parlato | 273/157 R |
| 4,358,115 | 11/1982 | Haas | 273/157 R |
| 4,361,328 | 11/1982 | Stein et al. | 273/156 |

*Primary Examiner*—William H. Grieb
*Attorney, Agent, or Firm*—Richard C. Litman

[57] ABSTRACT

A double sided picture or jigsaw type puzzle includes separate puzzles on both of the opposite sides of the puzzle sheet. The first side may include one or more separate individual picture puzzles, while the second side may also comprise one or more puzzles. Disassembly may be required of the assembled puzzle(s) of the first side, in order to assemble the puzzle(s) of the second side from the separate and individual puzzle pieces. Alternatively, the second side puzzle(s) may be assembled by joining the inverted and completed first side puzzle(s), depending upon the printing of the completed puzzle pictures. The individual puzzle pieces provide a myriad of different assemblies, due to the congruent nature of all, or almost all, of the puzzle pieces. The individual pieces are preferably formed of substantially triangular shapes with provision for cooperating interlocking, with right triangular pieces being used to form a completed substantially square or rectangular puzzle, and pieces having a substantially equilateral triangular form being used for the assembly of substantially hexagonal subassemblies, which subassemblies may be assembled to form a larger completed puzzle.

20 Claims, 5 Drawing Sheets

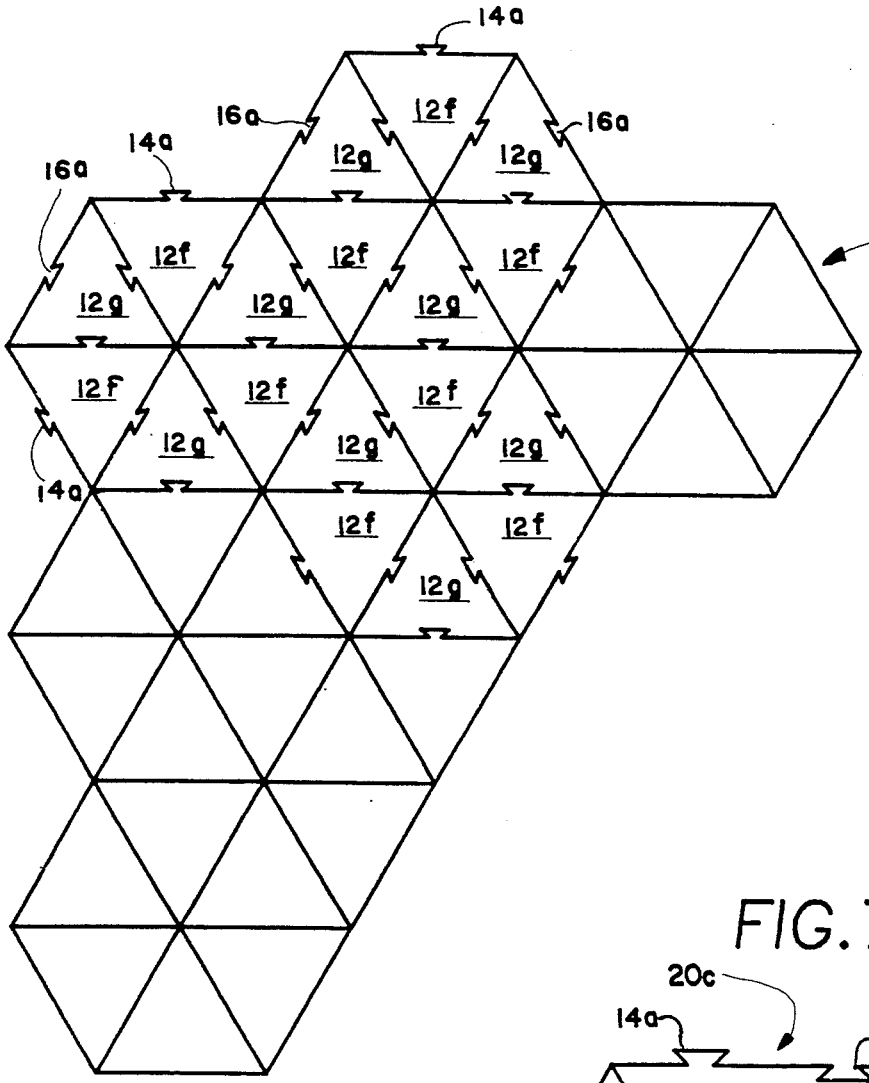
FIG. 8
FIG. 7
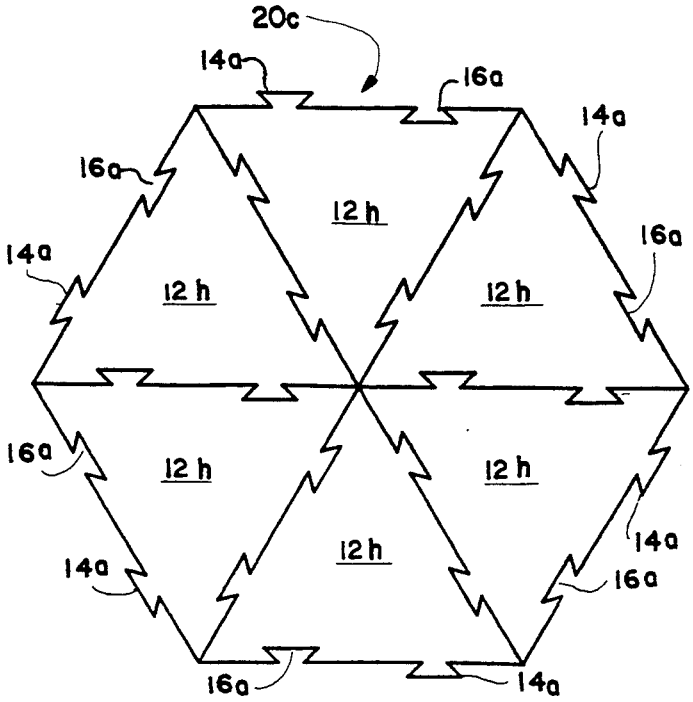

DOUBLE SIZED PUZZLE

REFERENCE TO RELATED APPLICATION

This application is a continuation in part of U. S. Pat. application Ser. No. 29/007,366, filed on Apr. 20, 1993.

FIELD OF THE INVENTION

The present invention relates generally to puzzles formed of a flat, planar sheet having multiple interlocking pieces (e.g., "jigsaw" puzzles), and more specifically to a puzzle having different puzzle faces on both sides of the sheet and having congruent geometrically shaped pieces which may be arranged in different relationships for the two puzzles on the opposite sides of the sheet. The geometrically shaped pieces may comprise essentially square or rectangular pieces, triangular pieces, or other shapes as desired, and at least the square or rectangular puzzle may include a single central piece of unique shape.

BACKGROUND OF THE INVENTION

With most persons being provided with ever increasing amounts of leisure time, various games, hobbies and pastimes have become increasingly popular. Many persons prefer an activity somewhat more active and involved than merely passively watching television or the like, however, and enjoy the challenge of solving a puzzle of some difficulty. So called "picture" puzzles in particular have an advantage in that they may be worked by a single person, and do not require a second or additional persons to act as an opponent(s), as do many games and the like.

The relative simplicity of the general concept, while still providing virtually unlimited complexity insofar as the number and combinations possible with the individual puzzle pieces, along with the ability of an individual to work alone, have maintained the popularity of such puzzles over the years. However, such puzzles have traditionally tended to a relatively few configurations over the years, primarily comprising a puzzle face printed upon only a single side of the sheet comprising the puzzle, with a multitude of uniquely shaped and generally interlocking puzzle pieces. The back side of the sheet is generally left blank, and such puzzles are generally of relatively large size in order to achieve the desired degree of difficulty for the assembler thereof.

The need arises for a picture puzzle which includes puzzle faces upon both sides of the puzzle sheet. By forming most or all of the individual puzzle pieces to have congruent shapes, or with only a very few different shapes for the multitude of pieces, a greater degree of difficulty may be achieved with fewer puzzle pieces, thus allowing the puzzle to be assembled in a smaller area. Conversely, greater difficulty may be achieved than with a conventional puzzle having an equal number of pieces and area. The present puzzle also provides for several different puzzles, by using individual quadrants or other partial areas of one side of the entire puzzle to form smaller individual puzzles, and/or using all of the pieces to form one or more puzzles on the opposite side of the sheet. The opposite puzzle(s) may be assembled from the individual puzzle pieces in an order completely different from that used for the assembly of the first side puzzle(s), or may comprise an assembly of the completed first side puzzles.

DESCRIPTION OF THE PRIOR ART

U.S. Pat. No. 1,339.399 issued to Walter D. Kemp on May 11, 1920 discloses an Educational Game Board having an appearance similar to an American flag. Only the field of stars in the upper left corner comprises puzzle pieces, with the field of stripes being fixed. While the field of stars includes reversible pieces having related interfitting elements on their reverse sides, the elements are not congruent, but are each differently shaped.

U.S. Pat. No. 1,532,875 issued to James Brown on Apr. 7, 1925 discloses a Puzzle comprising a plurality of modified hexagonal shapes each having alternating concave and convex arcuate sides. While the pieces are congruent, they do not actually interlock, it being a simple matter to withdraw one or more pieces from the other(s) by simple lateral movement. Jarring of the puzzle would dislodge the various pieces from one another, unlike the puzzle of the present invention. No second puzzle is disclosed on the opposite side.

U.S. Pat. No. 1,558,165 issued to George H. Haswell on Oct. 20, 1925 discloses a Puzzle formed of a plurality of hexagonal shapes, each side of which includes some marking or the like to be matched with another side of another piece. The pieces do not interlock, nor is a different puzzle disclosed on the opposite side.

U.S. Pat. No. 1,676,641 issued to Gustavus W. Eschenbach on Jul. 10, 1928 discloses Interchangeable Panoramic Picture Blocks capable of being rearranged linearly in order to vary the scene thereon. While the blocks may include a series of scenes on all sides, the only acceptable arrangements are linear, rather than in a two dimensional matrix. No interlocking is disclosed.

U.S. Pat. No. 1,948,962 issued to Ammiel F. Decker on Feb. 27, 1934 discloses a Picture Puzzle having pictures on both sides of the sheet comprising the puzzle pieces. Means are provided to distinguish one side from another of each piece, by tinting the surface of the sheet immediately beneath the picture imprinted thereover. The pieces are not geometrically similar, congruent, or regular, nor do they interlock, as in the present invention.

U.S. Pat. No. 2,984,489 issued to Frank Parlato on May 16, 1961 discloses a Picture Puzzle Game including congruently shaped puzzle pieces imprinted on opposite sides of the sheet. However, the puzzle is intended for smaller children, as a border is provided to enclose the non-interlocking pieces, and a copy of the picture of the completed puzzle is provided to assist the assembler.

U.S. Pat. No. 4,361,328 issued to Age Stein et al. on Nov. 30, 1982 discloses a Sheet Interfitting Section Puzzle having no congruent pieces, but in which each of the pieces is similarly shaped. A uniform border is also disclosed. Only one side of the sheet is used for a single puzzle, and the lack of congruent pieces is unlike the present puzzle.

U.S. Pat. No. DES. 267,895 issued to Patrick Petrie on Feb. 8, 1983 discloses a Puzzle design having a series of interlocking generally trapezoidally shaped pieces. The pieces are not congruent, as in the present puzzle, nor is any secondary puzzle disclosed on the reverse side of the sheet.

Finally, U.S. Pat. No. DES. 301,158 issued to John R. Fitzpatrick on May 16, 1989 discloses a Puzzle design formed of a plurality of identically shaped, irregular interlocking pieces. The pieces are set in a shallow board or tray having a raised periphery to contain the pieces, thus precluding the use of the opposite side for an additional puzzle.

None of the above noted patents, taken either singly or in combination, are seen to disclose the specific arrangement of concepts disclosed by the present invention.

SUMMARY OF THE INVENTION

By the present invention, an improved picture or jigsaw puzzle is disclosed.

Accordingly, one of the objects of the present invention is to provide an improved puzzle which includes puzzle faces on both of the two opposite sides of the single sheet comprising the puzzle.

Another of the objects of the present invention is to provide an improved puzzle in which all, or nearly all, of the puzzle pieces are identically shaped (congruent), and which interlock with one another for security of the assembled puzzle.

Yet another of the objects of the present invention is to provide an improved puzzle which provides for a plurality of individual puzzles on one side or face of the sheet, and which also provides for one or more separate puzzle(s) on the opposite or second side of the sheet. The puzzle(s) on the second side may be assembled from the individual puzzle pieces, or from the assembly of the completed puzzles of the first side of the sheet.

Still another of the objects of the present invention is to provide an improved puzzle which requires no separate border.

A further object of the present invention is to provide an improved puzzle which individual pieces may be formed as substantially right triangular shapes, and used to assemble a completed puzzle or puzzles of square or rectangular shape.

An additional object of the present invention is to provide an improved puzzle which individual pieces may be shaped substantially as equilateral triangles and used to assemble a completed puzzle or puzzles comprising one or more hexagonally shaped portions formed of the individual pieces.

A final object of the present invention is to provide an improved puzzle for the purposes described which is inexpensive, dependable and fully effective in accomplishing its intended purpose.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

FIG. 7 is a plan view of a portion of another puzzle similar to that of FIGS. 5 and 6, but with the congruent individual pieces each having completely congruent interlocking means.

FIG. 8 is a plan view of a puzzle assembled from a series of the modules of FIG. 6.

Similar reference characters denote corresponding features consistently throughout the several figures of the attached drawings.

DETAILED DESCRIPTION OF THE PREFERRED EMBODIMENTS

Figure 1:
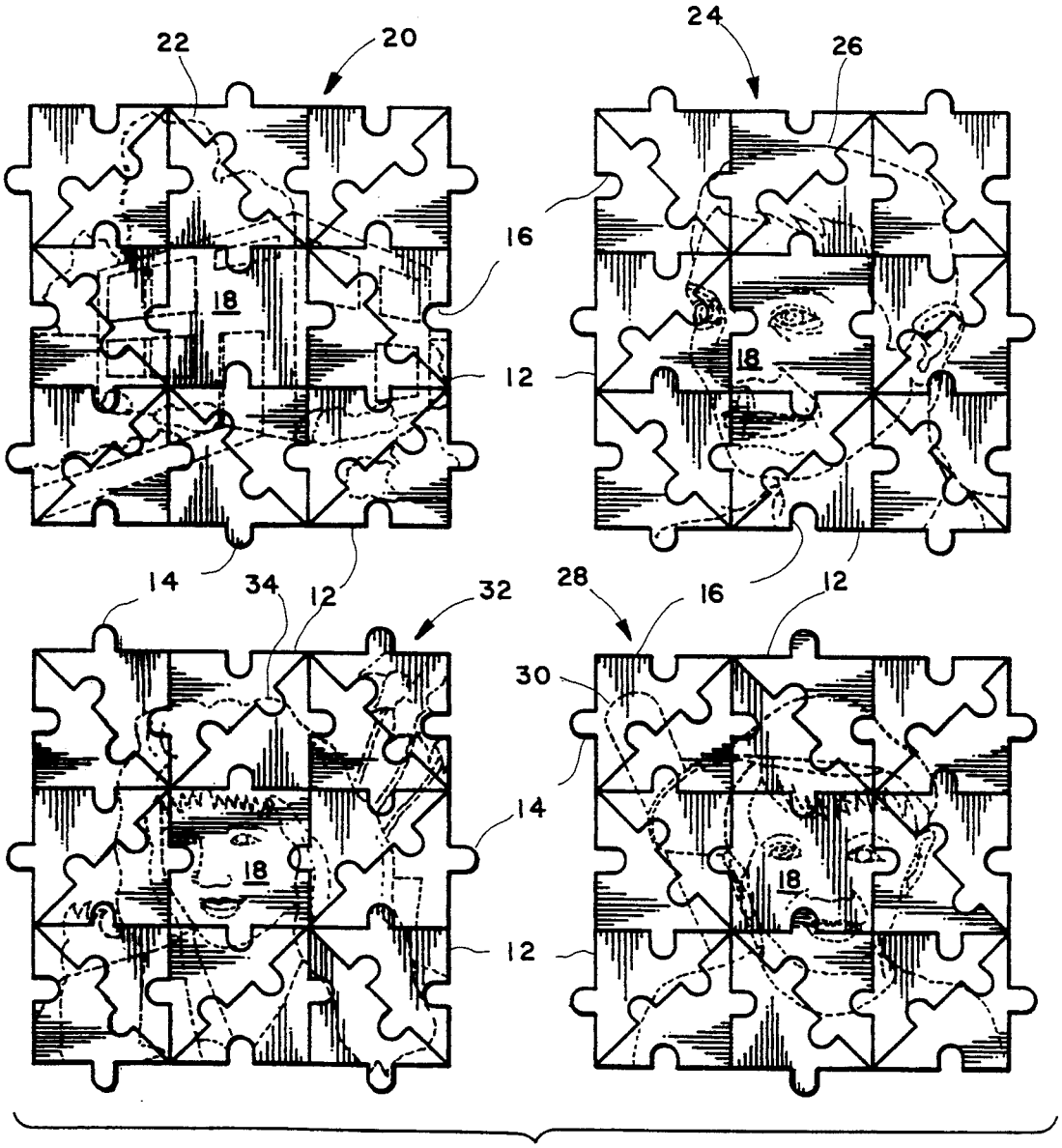
FIG. 1 is a partially exploded plan view of one embodiment of the present invention, showing a subassembly of four puzzles which may be assembled together.
Figure 2:
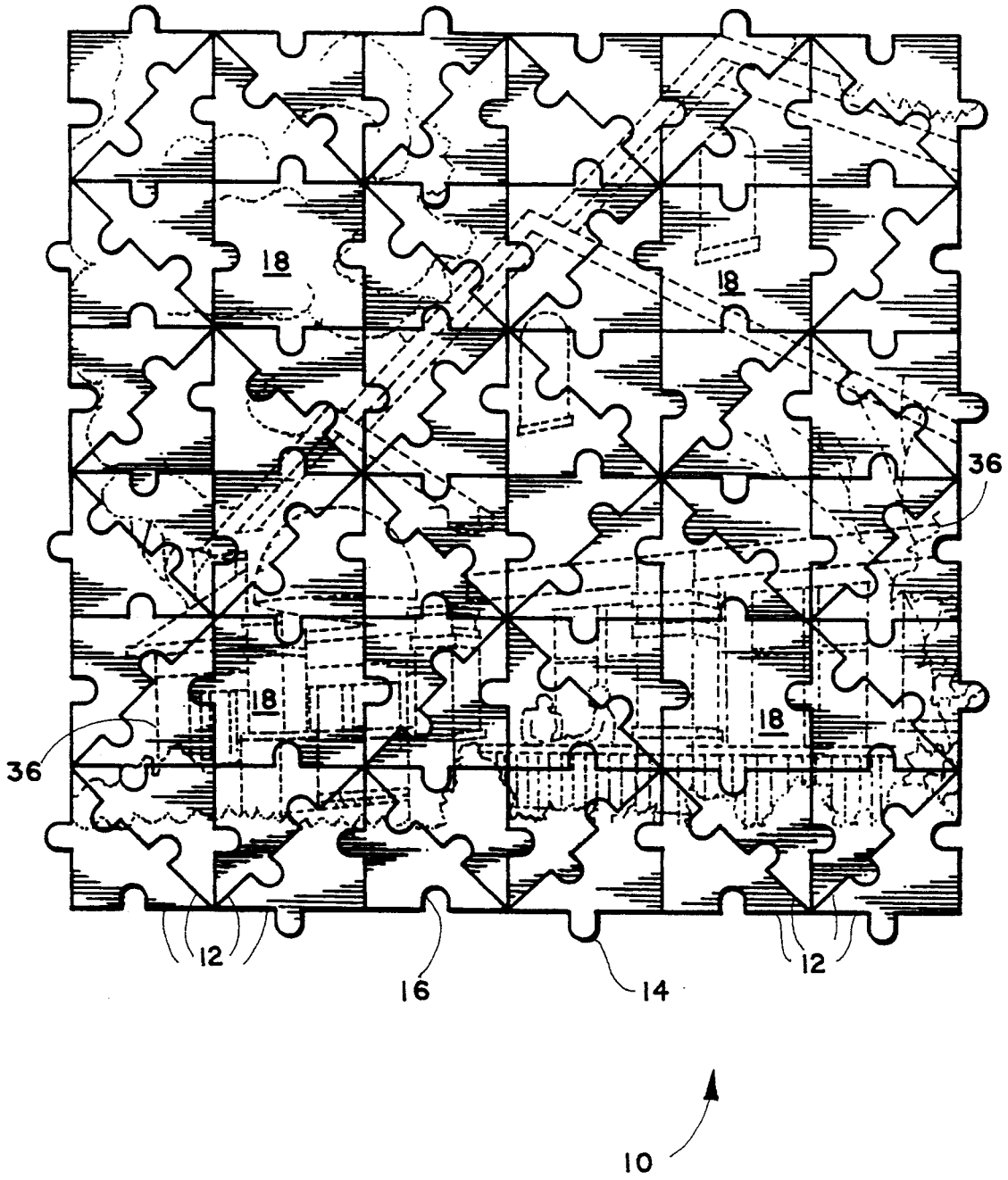
FIG. 2 is a plan view of the reverse side of the puzzle of FIG. 1, when the pieces are properly assembled.

Referring now particularly to FIGS. 1 and 2 of the drawings, the present invention will be seen to relate to a double sided puzzle 10 comprising a plurality of substantially triangular pieces 12, which pieces 12 may be assembled to form a completed sheet. It will be noted that each: of the separate puzzle pieces 12 are congruent to one another, differing only in the picture or pattern formed thereon. Each of the puzzle pieces 12 is substantially in the form of an isosceles right triangle, with the two sides to either side of the right angle being of equal length. By forming an extension tab 14 along one of the sides, a cooperating receptacle 16 in the other of the two sides, and both an extension 14 and receptacle 16 along the hypotenuse, the configuration of each of the pieces 12 will correspond precisely to one another. This precise congruence of each of the pieces 12 adds a significant challenge to the assembly of the present puzzle 10, even for a puzzle 10 with a relatively few pieces 12.

The above configuration of the pieces 12 will be seen to form a substantially square unit of two such pieces 12 when they are interlockingly assembled together by means of the cooperating extension 14 and receptacle 16 along their respective hypotenuses. A subassembly comprising an equal number of such two piece units along each side of the subassembly, will therefore also have a substantially square shape, as shown in FIG. 2. While the puzzle 10 of the present invention may comprise any practicable number of pieces 12, preferably at least a sufficient number of pieces 12 are used to form a module comprising a square of at least a three by three matrix of nine two piece units, or 18 pieces; larger or smaller modules may be formed at the discretion of the producer of a puzzle 10. Optionally, a symmetrical and substantially square center piece 18 may be provided as an "anchor" or starting point for the assembly of each of the modules used to form the present puzzle 10, if desired. It will be seen that the substantially square center piece 18 is congruent with an assembly or unit of two triangular pieces 12.

The substantially square shape of the puzzle 10 lends itself to the inclusion of more than one pattern, formed of markings on each of the pieces, upon at least one side of the puzzle sheet of the assembled pieces 12. FIG. 1 is exemplary of such a multiple pattern inclusion with the first or upper left module 20 having a first pattern 22, the second/upper right module 24 containing a separate second pattern 26, the third/lower left module 28 having a separate third pattern 30, and the fourth/lower right module 32 having a separate fourth pattern 34. The identical shape of all of the puzzle pieces 12 provides a significant challenge when each must be used in the assembly of the proper pattern.

The opposite second side of the puzzle 10 is shown in FIG. 2. An examination of the joints of the pieces 12 used in the assembly, reveals that the congruent shapes of the pieces (with the possible exception of the optional module center pieces 18) provide an assembly configuration identical to that used to form the modules used in the assembly of the multiple patterns formed on the first side of the puzzle 10 sheet. However, a different, single pattern 36 is formed on the second side of the pieces 12 forming the puzzle 10. While the four modules used in the formation of the four separate patterns of the first side of puzzle 10 may be inverted as subassemblies and assembled to form the completed pattern 36 of the second side, the congruent nature of the pieces 12 provides for their assembly in a multitude of different relationships. Thus, the second side pattern 36 may require a completely different assembly of the pieces 12 (and 18) than that used to form the modules for the patterns of the first side. Such a requirement adds even further challenge to the puzzle 10, effectively providing five separate puzzles for assembly. Alternatively, plural puzzles may be provided on the second side of the puzzle sheet, similar to the configuration of FIG. 1, with each of the plural puzzle assemblies corresponding to one of the plural puzzles of the first side of the sheet, or alternatively requiring disassembly of the completed first puzzles to form the plural puzzles of the second side of the sheet.

A conventional puzzle, having non-congruent pieces, may only be assembled with one relationship between the pieces, with each piece having a certain specific location in the puzzle matrix. Thus, when such a puzzle is completed, any pattern or picture formed on the reverse or second side will automatically be assembled as the first side is completed. No additional challenge is provided by imprinting the second side of the puzzle sheet with a second pattern. On the other hand, the congruent nature of the present puzzle pieces allows varying relationships between individual pieces during assembly, thus providing completely different puzzles on each side of the puzzle 10 sheet, if desired.

Figure 3:
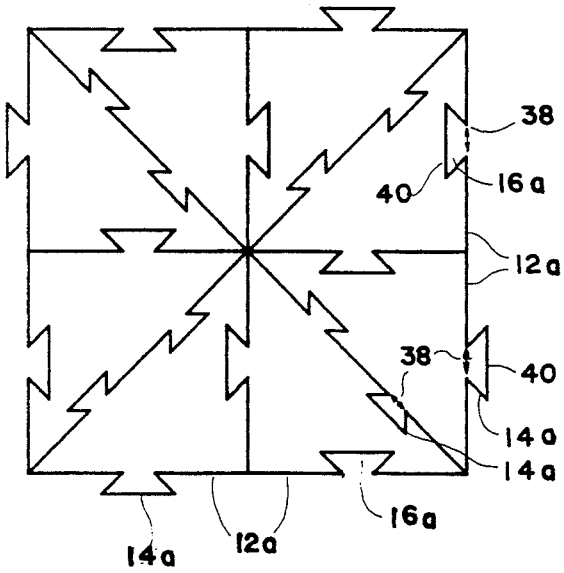
FIG. 3 is a plan view of a portion of an alternate puzzle, showing an alternate interlocking means for the pieces.

FIG. 3 discloses a subassembly of puzzle pieces 12*a*, each having shapes essentially similar to those of the puzzle pieces 12 of FIGS. 1 and 2. Each of the pieces 12*a* substantially comprises an isosceles right triangle, with one of the sides adjacent the right angle having an extension tab 14*a* thereon, the second side adjacent the right angle having a cooperating receptacle 16*a* therein, and the hypotenuse having both an extension 14*a* and a receptacle 16*a* formed therealong. Thus, each of the pieces 12*a* is congruent with each of the other pieces 12*a*, and may be assembled in a multitude of different relationships, only one of which will be correct for a given pattern formed thereon on a given side of a puzzle sheet formed by pieces 12*a*. Thus, the pieces 12*a* of FIG. 3 are substantially similar to the puzzle pieces 12 of FIGS. 1 and 2, discussed above, and the same challenge is provided by a puzzle formed of such pieces 12*a*.

The difference between the pieces 12 and 12*a* lies in the specific shape of the interlocking extensions and receptacles. While the extensions 14 and receptacles 16 of the pieces 12 each have a substantially rounded shape, the extensions 14*a* and receptacles 16*a* of the pieces 12*a* will be seen to be in the shape of trapezoids, with a relatively narrow base 38 along the side of the piece 12*a* and a relatively wide opposite or top edge 40 opposite the base 38. These trapezoidally shaped extensions 14*a* and receptacles 16*a* may provide additional interlocking strength for the pieces 12*a* over the rounded shapes of the extensions 14 and receptacles 16 of the puzzle pieces 12, due to the straight, flat edges and relatively sharp corners of the extensions 14*a* and receptacles 16*a* of puzzle pieces 12*a*.

Figure 3A:
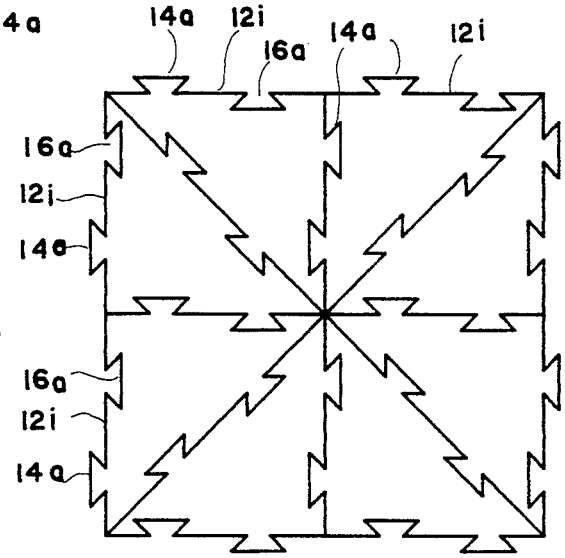
FIG. 3A is a plan view of a portion of another alternate puzzle, showing another alternate interlocking means.

FIG. 3A discloses a variation on the isosceles right triangular configuration of the puzzle pieces 12 and 12*a* discussed above. In FIG. 3A, the pieces 12*i* are all precisely congruent, as in the case of the puzzle pieces 12 and 12*a* discussed above, due to the alternating extension 14*a* and receptacle 16*a* formed along each of the three sides. Thus, each puzzle piece 12*i* includes three extensions 14*a*, alternating with three receptacles 16*a*, formed about the perimeter of each of the pieces 12*i*. As each of the puzzle pieces 12*i* is exactly the same shape as each other piece 12*i* used to form the puzzle of FIG. 3A, it will be seen that any piece 12*i* may be substituted for the position of any other piece 12*i*, in the manner of the puzzle pieces 12 of puzzle 10 of FIGS. 1 and 2. The result is a puzzle of exceedingly challenging nature.

Figure 4:
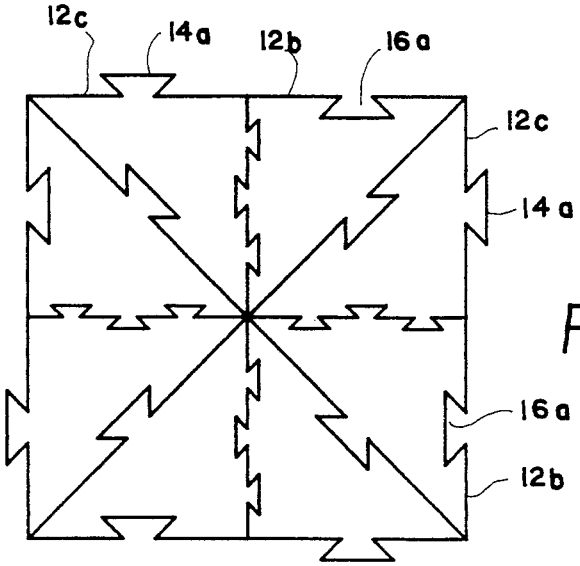
FIG. 4 is a plan view of a portion of yet another alternate puzzle, showing yet another interlocking means.

FIG. 4 discloses a further variation on the isosceles right triangular configuration of the puzzle pieces 12, 12*a* and 12*i* discussed above. In FIG. 4, the pieces are also in the general form of isosceles right triangles, but are of two different groups or configurations, 12*b* and 12*c*. Puzzle pieces 12*b* and 12*c* each have a single receptacle 16*a* (for pieces 12*b*) or single extension 14*a* (for pieces 12*c*) along one side adjacent to the right angle, and three alternating receptacles and extension 14*a* and 16*a* (for pieces 12*b*) or three alternating extensions and receptacle 16*a* and 14*b* (for pieces 12*c*) along the other side adjacent to the right angle. The hypotenuse contains a single extension 14*a* (piece 12*b*) or receptacle 16*a* (piece 12*c*). The above described puzzle pieces 12*b* and 12*c* may be assembled to form units of two pieces each, which units are all congruent. However, the two different groups of pieces 12*b* and 12*c* result in a relatively limited number of possible assembly combinations, in comparison to a single puzzle 10 formed entirely of a single shaped puzzle piece 12 or 12*i*. Nevertheless, the use of only two differently shaped types of puzzle pieces 12*b* and 12*c* in a puzzle which may have over 500 pieces, will be seen to provide a difficult challenge for even veteran puzzle assemblers.

A variation on the right triangular puzzle pieces 12 through 12*b* discussed above, is shown in FIGS. 5 through 7. In these figures, the puzzle pieces each have substantially the shape of an equilateral triangle, which shape by definition provides three edges of equal length. These three edges are identical, with the exception of the specific interlocking means of each of the edges, depending upon the specific embodiment and groups of interlocking pieces. Six of these pieces may be assembled in a hexagonal module, e.g., module 20*a* of FIG. 5.

Figure 5:
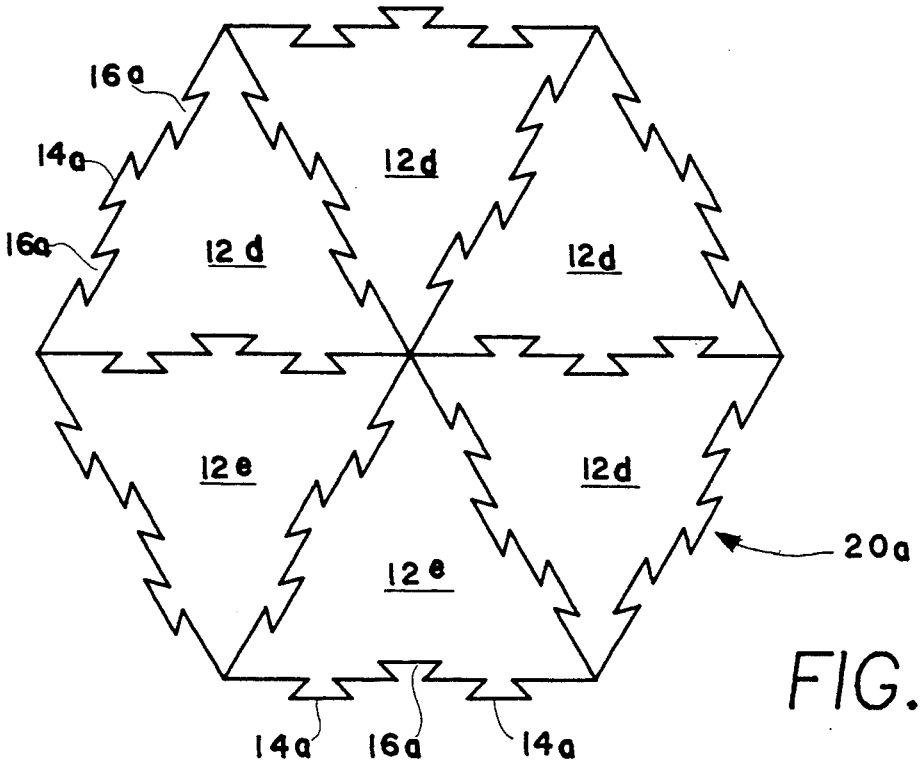
FIG. 5 is a plan view of a portion of yet another alternate puzzle, formed of a plurality of substantially equilateral triangular pieces.

The arrangement of the various extensions 14*a* and receptacles 16*a* of puzzle pieces 12*d* and 12*e* of FIG. 5 will be seen to be similar to the multiple extensions 14*a* and/or receptacles 16*a* in the puzzle pieces 12*b* and 12*c* of FIG. 4, discussed above, in that each of the sides of the triangular pieces 12*d* and 12*e* includes such multiple interlocking means. However, pieces 12*d* will be seen to have two sides each with a central extension 14*a*, and only one side with a central receptacle 16*a*; pieces 12*e* each have only one side with a central extension and two sides with central receptacles. Thus, while the puzzle pieces 12*d* and 12*e* each comprise a different group, the pieces of the two groups all have substantially the same shape, with the difference lying in the specific number of sides of the piece having a given configuration of interlocking extensions 14*a* and receptacles 16*a*. This difference in configuration will be seen to limit the order in which the pieces 12*d* and 12*e* may be assembled, as in the case of the puzzle pieces 12*b* and 12*c* of FIG. 4. It will be seen that even though such pieces 12*d* and 12*e* may be assembled to form a hexagonal module 20*a* in several relationships between the pieces, only one relationship may be correct in that the arrangement of extensions 14*a* and receptacles 16*a* along the outer edge of the module has the proper arrangement for mating with another module to continue the assembly of a larger puzzle. Again, it will be seen that the various embodiments of the present puzzle, e.g., pieces 12*d* and 12*e* of FIG. 5, may provide an extremely challenging puzzle with a minimal number of pieces, with the challenge increasing considerably as the number of pieces required for a given puzzle are increased.

Figure 6:
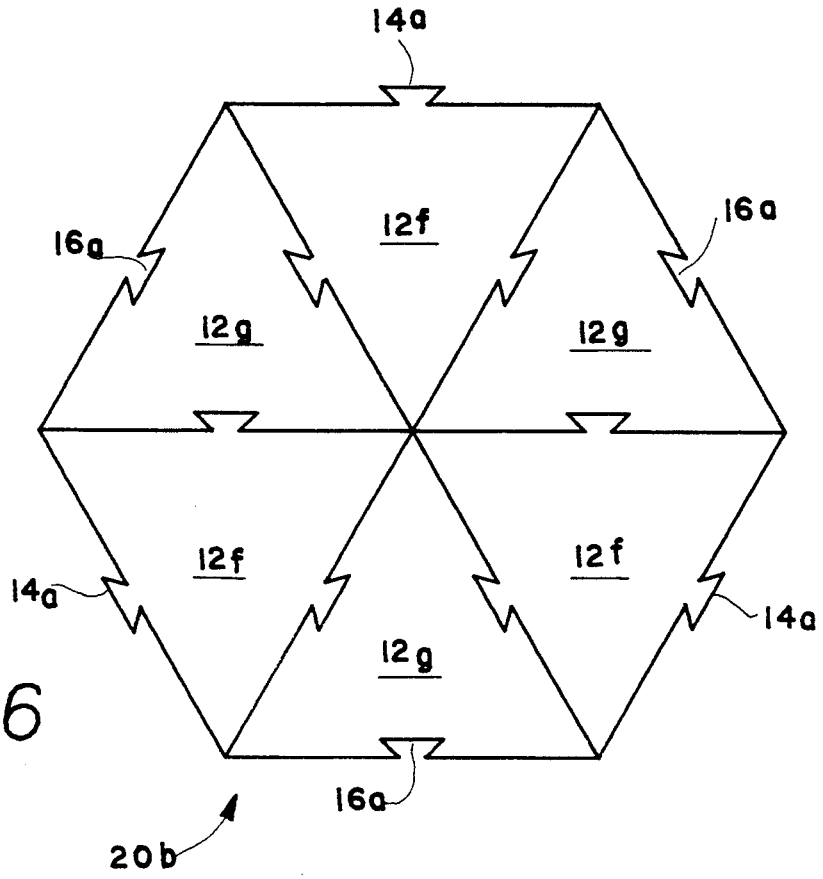
FIG. 6 is a plan view of a portion of a puzzle similar to that of FIG. 5, but having an alternative interlocking means.

FIG. 6 discloses another two groups of puzzle pieces 12*f* and 12*g*, each again having substantially an equilateral triangular form. The mutual interlocking means comprising the various extensions 14*a* and receptacles 16*a* are simplified in pieces 12*f* and 12*g*, in that only a single extension 14*a* or receptacle 16*a* is formed along each of the sides of the pieces 12*f* or 12*g*. Puzzle pieces 12*f* will each be seen to have a single extension 14*a* along each of the sides of the pieces, while pieces 12*g* each include a single receptacle 16*a* along each of their sides. By alternatingly assembling such pieces 12*f* and 12*g* to form a hexagonal module 20*b* of six pieces, a plurality of such modules 20*b* may be assembled to form a larger puzzle 10*a*, as shown in FIG. 8. While the lesser number of interlocking means of each of the pieces 12*f* and 12*g* lessen the challenge of completing a puzzle 10*a* of such pieces, the challenge is still great, due to the two groups of identical pieces and the large number of pieces in each group.

As noted above, each of the pieces discussed thus far may be assembled with cooperating pieces in several different configurations. However, none of the puzzle pieces 12 through 12*g* provide for truly universal fit with any of the other pieces along any of their sides. In the cases of the pieces 12 of FIGS. 1 and 2 and pieces 12*a*, 12*b*, and 12*c* of FIGS. 3 and 4, the right triangular configuration precludes the assembly of such pieces along their hypotenuse with any other sides but the hypotenuses of the other pieces. That is, a side adjacent the right angle cannot be assembled with the hypotenuse side of another piece. In the cases of the puzzle pieces 12*d* through 12*f* of FIGS. 5 and 6, the two groups of pieces required for each of the puzzle configurations precludes universal fit. The different configurations of the interlocking means along the equilateral sides limits the assembly of the side of one piece to another side having a complementary interlocking configuration. While the above shapes and configurations provide for relatively great complexity and challenge, even greater challenge could be achieved if the equilateral pieces were provided with truly identical interlocking side configurations, as in the case of the puzzle pieces 12*i* of FIG. 3A discussed above.

Accordingly, the configuration disclosed in FIG. 7 was developed to provide such greater challenge. The module 20*c* of FIG. 7 is formed of six identical pieces 12*h*, each comprising a substantially equilateral triangular shape. Each of the sides of each of the pieces 12*h* are of equal length to one another, and the configuration of the interlocking means is identical on each of the sides. Thus, each side includes a single trapezoidally shaped extension tab 14*a* and a single mating receptacle 16*a*, equally spaced and positioned along each of the sides. The resulting configuration not only provides for the assembly of any piece 12*h* in the place or position of any other piece 12*h*, but further allows any of the pieces 12*h* to be installed in one of three orientations even when that piece 12*h* is installed in its proper location in the puzzle. The precisely congruent pieces 12*h* will thus be seen to provide a puzzle which has a degree of difficulty some six times that of puzzles formed of pieces 12*d* and 12*e*, or of pieces 12*f* and 12*g*, due to their composition of two groups of non-identical pieces and the non-identical configuration of the interlocking means along each side, even though the pieces are substantially similar due to their equilateral triangular configurations.

Thus, the present invention will be seen to provide various embodiments of picture or "jigsaw" puzzles each comprising a plurality of congruent puzzle pieces. In some configurations, all of the pieces of a given:puzzle may be congruent, while in other cases the pieces may be comprised of two groups, with congruent pieces in each group. The congruent nature of the puzzle pieces provides for a multitude of different relationships between individual pieces resulting in a proper fit; however, only a single relationship will result in the proper formation of the pattern(s) on the puzzle face(s). This enables at least two entirely different puzzles to be provided from the same pieces, by providing a pattern on both sides of the pieces and requiring a different assembly of the pieces for each of the puzzles.

In another embodiment, several patterns may be provided on a single puzzle surface, with each pattern assembled from individual puzzle pieces to form a puzzle module. The modules may then be assembled together to form a completed puzzle. While it is possible to provide a second or subsequent pattern(s) on the reverse side of the puzzle sheet using the same relationship of assembled puzzle pieces and which is simultaneously completed as the first puzzle is completed, the second or additional pattern(s) on the second puzzle surface may require the disassembly of the puzzle and reassembly of the individual pieces in a completely different relationship to complete the second puzzle(s). The substantially congruent puzzle pieces of the present invention provide for such. Accordingly, plural picture puzzles of relatively great difficulty are provided by the present invention, depending upon the number of puzzle pieces comprising the puzzle sheet, resulting in a relatively great challenge for the puzzle enthusiast. A puzzle of equal difficulty to a conventional puzzle may be achieved with fewer individual puzzle pieces, thus reducing production costs for such a difficult puzzle and making such a puzzle more readily available to those who enjoy such pastimes.

It is to be understood that the present invention is not limited to the sole embodiments described above, but encompasses any and all embodiments within the scope of the following claims.

I claim:

1. A double sided puzzle comprising:

a sheet having a first side and an opposite second side formed of puzzle pieces each having a substantially triangular shape, with said puzzle pieces including at least one group wherein said puzzle pieces are congruent, and with each of said puzzle pieces including cooperating means providing for the mutual interlocking of said puzzle pieces to form said sheet, and;

each of said puzzle pieces having a first side and an opposite second side, with said first side and said second side of each of said puzzle pieces each having markings thereon which form at least one first pattern and at least one second pattern respectively upon said first side and said second side of said sheet when said puzzle pieces are respectively assembled to form a state of said sheet wherein said at least one first pattern and said at least one second pattern are completed, whereby;

each said first side of said puzzle pieces is oriented to face upwards and said puzzle pieces are interlockingly and properly assembled to form at least one said state of said sheet with at least one said pattern being completed thereby.

2. The double sided puzzle of claim 1 including:

means providing for the mutual formation of said first state and said second state when said puzzle pieces are assembled to form said sheet, whereby;

said first pattern and said second pattern of said double sided puzzle are simultaneously completed.

3. The double sided puzzle of claim 1 including:

means precluding the mutual formation of said first state and said second state when said puzzle pieces are assembled to form said sheet, whereby;

the formation of said second state requires the disassembly of said puzzle pieces from an assembled first state, and the reassembly of said puzzle pieces in a different arrangement from that of said first state.

4. The double sided puzzle of claim 1 wherein:

said first side of said sheet includes plural patterns thereon, whereby;

each of said plural patterns is completed by assembling said puzzle pieces respectively corresponding to each of said plural patterns to form a plurality of completed modules, and said modules are assembled to complete said sheet.

5. The double sided puzzle of claim 4 wherein:

at least one of said puzzle pieces of each of said plural patterns is substantially square and respectively disposed substantially in the center of said each of said plural patterns when said double sided puzzle is completed.

6. The double sided puzzle of claim 1 wherein:

said second side of said sheet includes plural patterns thereon, whereby;

each of said plural patterns is completed by assembling said puzzle pieces respectively corresponding to each of said plural patterns to form a plurality of completed modules, and said modules are assembled to complete said sheet.

7. The double sided puzzle of claim 6 wherein:

at least one of said puzzle pieces of each of said plural patterns is substantially square and respectively disposed substantially in the center of said each of said plural patterns when said double sided puzzle is completed.

8. The double sided puzzle of claim 1 wherein:

each of said puzzle pieces is substantially in the form of an isosceles right triangle, and said sheet is substantially square.

9. The double sided puzzle of claim 8 wherein:

at least one of said puzzle pieces is substantially square and disposed substantially in the center of said sheet when said double sided puzzle is completed.

10. The double sided puzzle of claim 1 wherein:

each of said puzzle pieces is substantially in the form of an equilateral triangle, and said puzzle pieces are assembled to form said sheet comprising at least one hexagonally shaped module.

11. The double sided puzzle of claim 10 wherein:

said sheet includes a plurality of said hexagonally shaped modules when said sheet is assembled from said puzzle pieces.

12. The double sided puzzle of claim 1 wherein:

said puzzle pieces are all mutually congruent.

13. The double sided puzzle of claim 12 wherein:

each of said puzzle pieces is of an equilateral triangular configuration.

14. The double sided puzzle of claim 12 wherein:

each of said puzzle pieces is of an isosceles right triangular configuration.

15. The double sided puzzle of claim 1 wherein:

said puzzle pieces comprise a first group and a second group, with said puzzle pieces of said first group being mutually congruent and said puzzle pieces of said second group being mutually congruent.

16. The double sided puzzle of claim 15 wherein:

said puzzle pieces of said first group each include a plurality of extensions and said puzzle pieces of said second group each include a plurality of receptacles, with said extensions of said puzzle pieces of said first group interlockingly engaging with said receptacles of said puzzle pieces of said second group.

17. The double sided puzzle of claim 1 wherein:

said cooperating means providing for the mutual interlocking of said puzzle pieces to form said sheet comprises at least one extension extending from each of said puzzle pieces and at least one cooperating receptacle formed in each of said puzzle pieces, whereby;

said at least one extension of each of said puzzle pieces is interlockingly engageable with said at least one cooperating receptacle of each other of said puzzle pieces.

18. The double sided puzzle of claim 17 wherein:

each of said puzzle pieces includes plural extensions extending therefrom and plural receptacles formed therein.

19. The double sided puzzle of claim 17 wherein:

each of said extensions comprises a substantially semicircular shape, and each of said receptacles comprises a shape congruent to said substantially semicircular extensions.

20. The double sided puzzle of claim 17 wherein:

each of said extensions comprises a substantially trapezoidal shape having a first base side and an opposite second side with said second side being wider than said base side, and each of said receptacles comprises a substantially trapezoidal shape congruent to said substantially trapezoidal extensions.

* * * * *